US005676606A

United States Patent [19]

Schaeffer et al.

[11] Patent Number: 5,676,606

[45] Date of Patent: Oct. 14, 1997

[54] GOLF PUTTER

[75] Inventors: Barry M. Schaeffer, San Diego; Robert W. Vokey, Carlsbad, both of Calif.; Jeffrey D. Sheets, Wilbraham, Mass.

[73] Assignee: The Founders Club Golf Company, Vista, Calif.

[21] Appl. No.: 525,842

[22] Filed: Sep. 8, 1995

[51] Int. Cl.[6] ..... A63B 53/04

[52] U.S. Cl. ..... 473/340; 473/341; 473/350

[58] Field of Search ..... 473/324, 328, 473/332, 340, 341, 345, 349, 350

[56] References Cited

U.S. PATENT DOCUMENTS 1,096,359 5/1914 Dwight ..... 273/169

1,780,625 11/1930 Mattern ..... 273/169

3,220,733 11/1965 Saleeby ..... 273/171

*Primary Examiner*—George J. Marlo

*Attorney, Agent, or Firm*—Brown, Martin, Haller & McClain

[57] ABSTRACT

A golf putter head has a main body portion with a front, striking face, a lower, sole face, a heel, a toe, and a rear face, and an arcuate indent or recess in the sole face extending out to the outer perimeter of the heel, toe and rear face. The main body portion is of a first material, and an arcuate weighting member of a second material heavier than the first material is secured in the indent. The weighting member has a lower face flush with the sole face of the main body portion, and an outer peripheral face flush with the adjacent outer perimeter portions of the rear face, heel and toe of the body portion.

12 Claims, 3 Drawing Sheets

GOLF PUTTER

BACKGROUND OF THE INVENTION

The present invention relates generally to golf clubs, and is particularly concerned with a golf putter.

The two basic known styles of golf club putter are the mallet style and the blade style. The mallet style putter has a relatively large, solid putter head, while the blade style has a relatively narrow or blade-like head. Each type of club has a generally flat, forward striking face for hitting the ball, and accuracy of the shot is dependent on where the striking face impacts the ball as well as the orientation of the striking face on impact. Generally, accuracy depends on hitting the ball at a central area of the striking face, known as the "sweet spot." Generally, control of the direction of travel of the struck ball decreases with distance away from the optimum striking area. The effective hitting area may be increased by appropriate weighting. Weighting may also be used to improve feel and stability of the putter.

Golf putters have designed in the past with embedded weights at various positions in the club head. Lead shot or tungsten has been embedded in bores or ports at appropriate positions in the head. In U.S. Pat. No. 4,010,958 of Long, a generally square shaped putter head is described in which weight is added at the corners of the club head to increase the effective hitting area at the front face. U.S. Pat. No. 5,324,031 of Green describes a putter head which is multi-layered and has a hollow interior in which lead shot is encapsulated to provide a desired weighting effect.

SUMMARY OF THE INVENTION

It is an object of the present invention to provide a new and improved golf club putter with an improved weighting system.

According to the present invention, a golf club putter is provided, comprising an elongate shaft having an upper end and a lower end, and a club head secured to the lower end of the shaft, the head having a main body portion with a front, striking face and a sole face extending rearwardly from the striking face, and an outer perimeter defining heel, toe and rear faces of the club head, the main body portion having an arcuate indent in the sole face extending outwardly to the outer perimeter of the heel, toe and rear faces, and an arcuate weighting member secured in the indent, the weighting member being of shape and dimensions matching the shape and dimensions of the indent and having a lower face extending flush with the lower sole face and an outer peripheral edge flush with the outer perimeter of the heel, toe and rear faces. The weighting member is of a higher density material than the body portion.

Preferably, the recess extends around the entire rear face and at least part of the heel and toe of the club, so that weighting is provided around the majority of the outer perimeter of the head up to positions close to or adjacent the striking face. The attached weighting member will act the lower the center of gravity of the club head and also provide weighting around the outer perimeter of the head, rather than at positions spaced inwardly from the outer perimeter as in the past. This provides a solid feel to the club head, and improves stability in striking the ball. The club head will be less expensive to construct than similar club heads having internal weighting systems.

In one embodiment of the invention, the putter head is of the mallet style, comprising a solid body with a generally flat, front striking face, an upper face to which the shaft is secured, and an arcuate perimeter defining the heel, toe and rear faces of the club. The recess preferably extends around the rear face of the club and part of the heel and toe, having opposite ends terminating short of the front, striking face, and is generally horseshoe shaped. The weighting member is of equivalent horseshoe shape and may be secured in the recess by casting the main body of the club head around the previously cast weighting member. This is a convenient and inexpensive procedure for manufacturing the head, and is possible due to the positioning of the weighted member at the outer perimeter of the head rather than inset from the perimeter. However, the weighting member may alternatively be attached by adhesive bonding or welding, for example, although this will be a more expensive technique for making the club.

In an alternative embodiment, the head is of the blade type and the main body comprises a relatively thin striking plate, and a body portion comprising a sole plate extending rearwardly from the lower end of the striking plate. The sole plate has a rearwardly facing recess in which the weighting member is secured, with the weighting member forming a rearward continuation of the sole plate and having a thickness equal to that of the sole plate.

In each embodiment, the main body of the putter head is of low density material such as aluminum while the external weighting member is of high density material such as brass. The main body will therefore have a desirable soft feel on impact with the ball while the external weighting member will produce a solid feel on swinging the club and enhanced stability, reducing the rotational effect of hitting a ball off-center.

The golf putter may be made by first forming a weighting member of a first material, with keying formations on the outer surface of the weighting member, placing the weighting member in a predetermined position in a cavity having surfaces shaped to form a golf club putter head having a front, striking face, a sole face, heel and toe faces, and a rear face, the weighting member being positioned with part of its outer surface flush with part of the cavity surface forming the sole face, rear, heel and toe faces of the club, and forcing a second material of lower density than the first material to flow into the cavity and around the weighting member and keying formations to form the remainder of the club head body with the weighting member secured to the remainder of the body.

The keying formations may be any suitable formations for securing the weighting member to the remainder of the club body when cast, such as projections, depressions, undercuts and the like.

The putter head with external horseshoe or arcuate shaped weighting will be less expensive to manufacture than putter heads incorporating internal weights, and will provide equivalent or improved performance over such heads. The external weight is provided at the outer periphery of the club head for improved perimeter weighting properties.

BRIEF DESCRIPTION OF THE DRAWINGS

The present invention will be better understood from the following detailed description of some preferred embodiments of the invention in conjunction with the accompanying drawings, in which like reference numerals refer to like parts, and in which.

DESCRIPTION OF THE PREFERRED EMBODIMENTS

Figure 1:
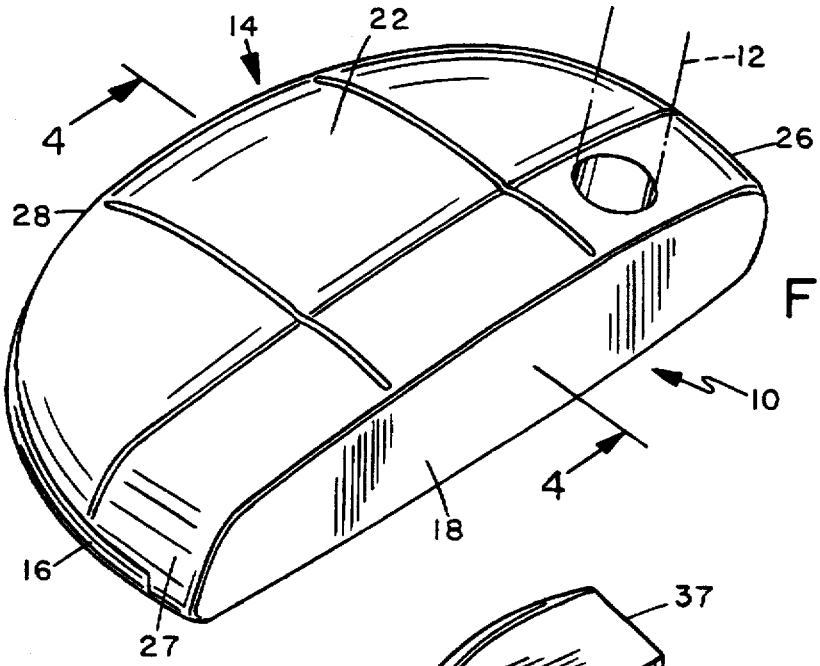
FIG. 1 is a perspective view of the top of a putter according to a first embodiment of the invention, incorporating a horseshoe weight.
Figure 2:
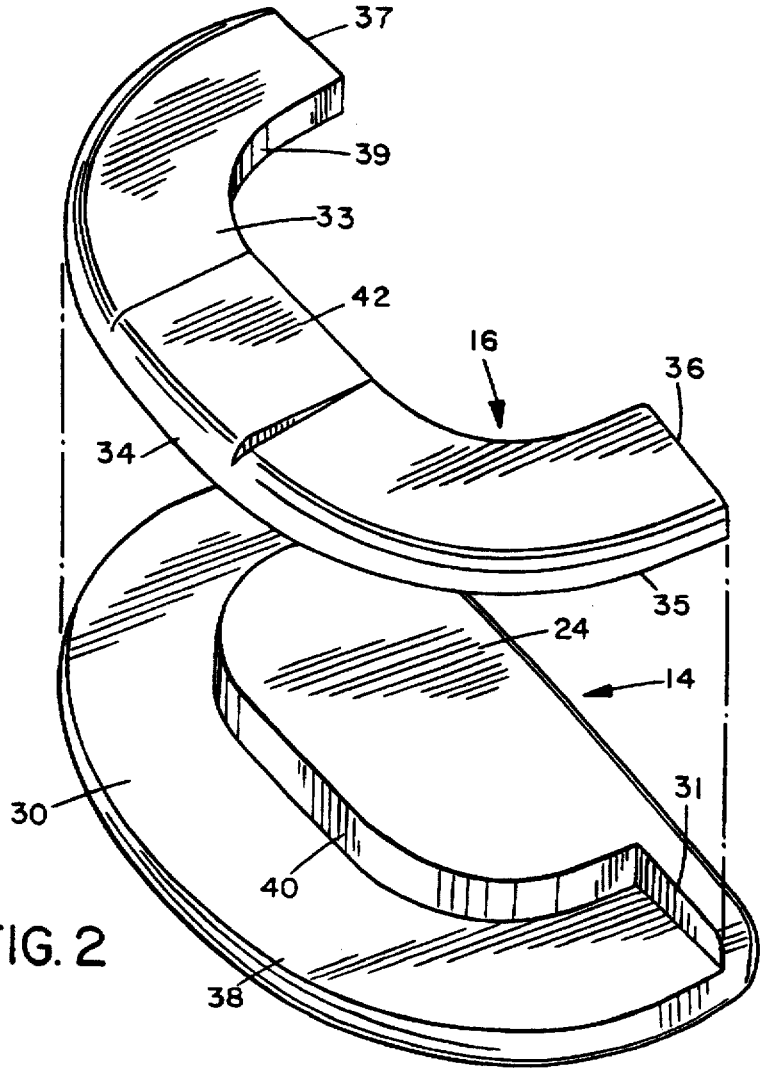
FIG. 2 is a perspective view from below with the weight detached.
Figure 3:
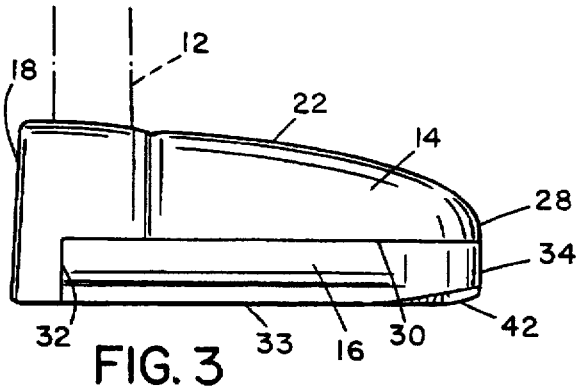
FIG. 3 is an end view of the putter.

FIGS. 1–4 of the drawings illustrate a golf club putter head 10 according to a first embodiment of the invention, which is designed to be attached to the lower end of an elongate golf club shaft 12 as illustrated in FIGS. 1 and 3. The club head 10 is of the so-called mallet style and comprises a solid main body portion 14 and a separately formed, horseshoe-shaped weighting member 16 which is secured externally to the main body.

The body portion 14 has a generally flat, front striking face 18 and a rearwardly extending body portion having a downwardly curved upper face 22, a generally flat lower face or sole 24, and an arcuate outer perimeter forming a heel face 26, a toe face 27, and a curved rear face 28. A bore 29 in the upper face 22 of the body extends inwardly in a direction generally parallel to front face 18, for receiving the end of shaft 12. A generally horseshoe-shaped recess 30 is formed in the lower face 24 of the club head, extending out to the outer perimeter of the head around rear face 28 and at least part of the heel and toe faces 26 and 27. Recess 30 terminates at flat end faces 31,32 short of the striking face 18, as best illustrated in FIGS. 2 and 3. Alternatively, the recess may extend up to and through the striking face, if desired.

Figure 4:
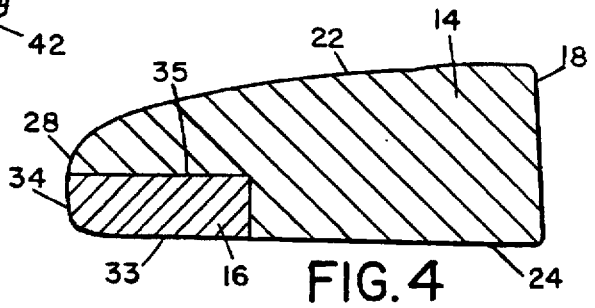
FIG. 4 is a sectional view taken on line 4—4 of FIG. 1.

The weighting member 16 is a solid, horseshoe-shaped member of shape and dimensions matching those of recess 30, as best illustrated in FIG. 2. When weighting member 16 is secured in the recess, the outwardly facing lower surface 33 will be flush with the adjacent sole face of the main body, and the outer periphery 34 will be flush with the adjacent outer perimeter surfaces of the rear, heel and toe portions of the main body 14, as illustrated in FIGS. 1, 3 and 4, so that the insert or weighting member forms a smooth continuation of those surfaces. The lower face 33 of the weighting member is substantially flat and forms a continuation of the sole or lower surface 24 of the main body, as illustrated in FIG. 4, with a raised, wedge portion 42 formed at the center of face 33. Weighting member 16 has a flat upper surface 35 and flat opposite ends 36,37, for mating engagement with the corresponding flat inner face 38 and end faces 31,32, respectively, of the recess. A curved inner edge 39 fits against the corresponding curved edge 40 of recess 30 so that the weighting member is a close, mating fit in the recess.

The horseshoe shaped weighting member extends up to a position close to, but spaced rearwardly from, the front striking face. This provides desirable perimeter weighting to the striking face while the remainder of the weighting member acts to lower the center of gravity and move it rearwardly, reducing the tendency of the club head to twist if the ball is struck off-center, and thus improving stability.

Figure 8:
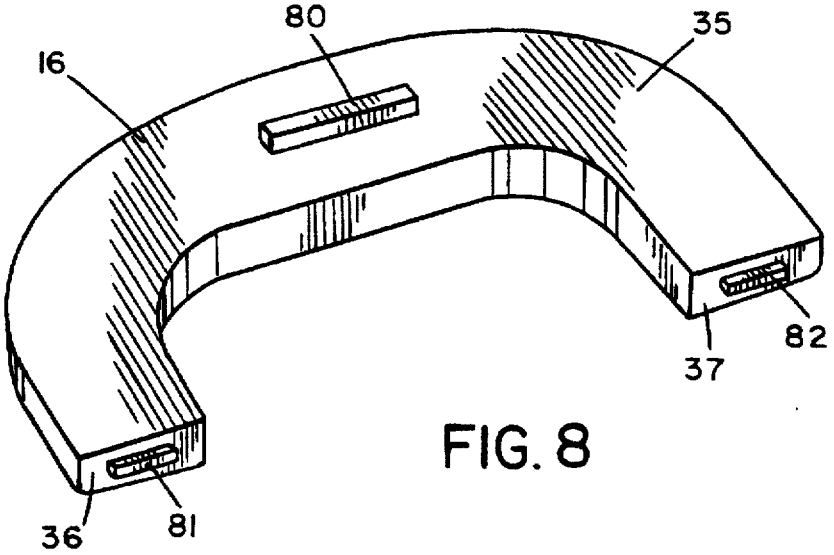
FIG. 8 is a perspective view of the weight, showing interlocking keys.
Figure 9:
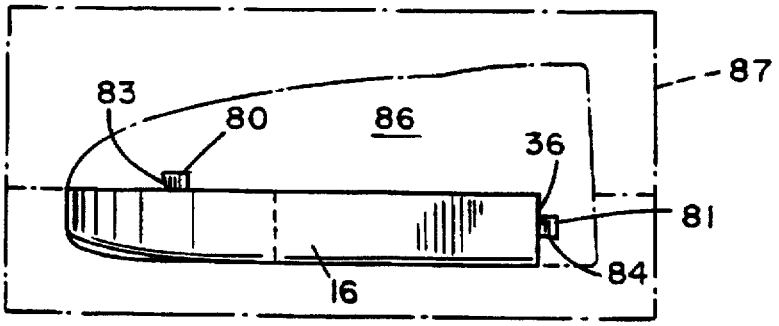
FIG. 9 is a side elevation view of the weight positioned in a mold box, which is indicated in broken line.
Figure 10:
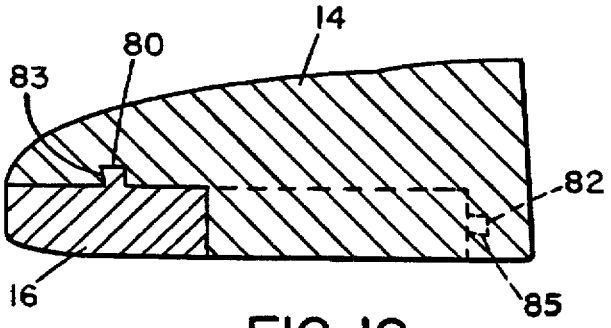
FIG. 10 is a sectional view similar to FIG. 4, showing the interlocked weight and club head body.

The main body 14 of the club head is made of a low density metal such as aluminum or the like which has a relatively soft feel and is relatively light in weight. The horseshoe-shaped weighting member 16 is of high density, heavier metal such as brass or the like. Weighting member 16 may be secured in recess 30 in any suitable manner, for example by bonding or welding. However, in a preferred embodiment, weighting member 16 is first formed into the shape illustrated, and is then placed into a mold cavity which is shaped and dimensioned to correspond to the final club head shape. The weighting member is suitably positioned in the second mold cavity and the main body 14 is then cast around it to form the recess and simultaneously secure the weighting member in the recess. This method is illustrated in FIGS. 8–10 and described in more detail below. The external, horseshoe-shaped weighting arrangement will provide a lower center of gravity and will also provide a more solid feel and stability to the club head. This will provide improved accuracy in ball direction. By providing the weighting member in a single piece, construction is simplified. The dimensions of the recess and weighting member will be dependent on the amount of weighting required.

Figure 5:
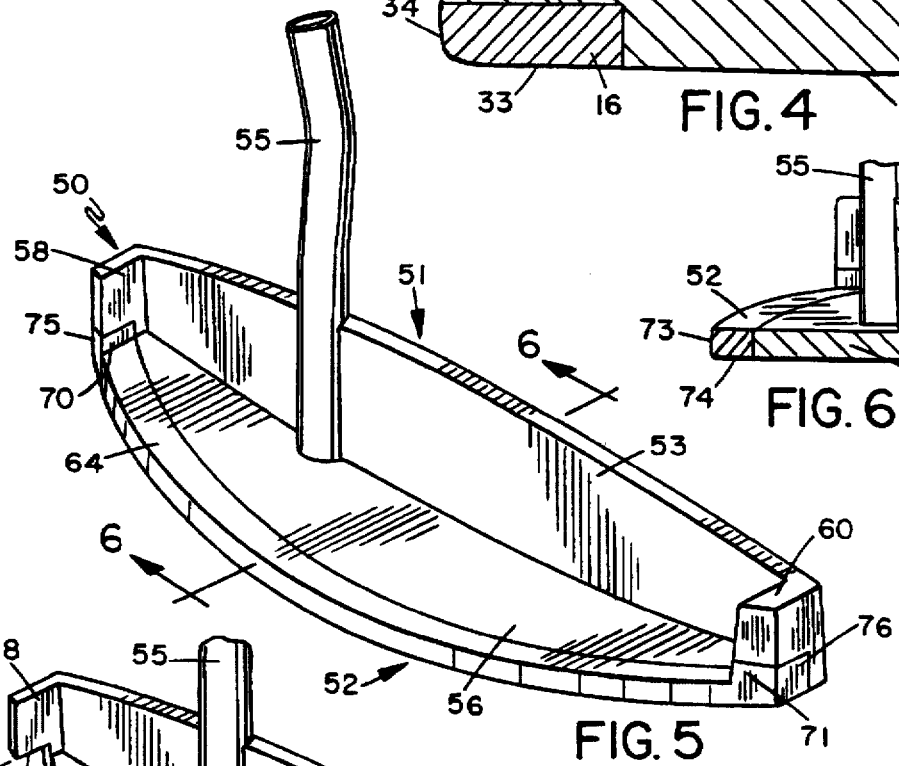
FIG. 5 is a perspective view from the rear of an open style putter according to a second embodiment of the invention, with the weight in place.
Figure 6:
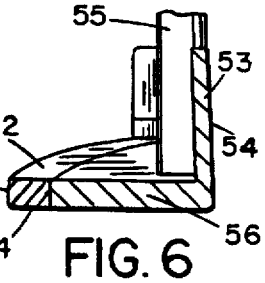
FIG. 6 is a sectional view taken on line 6—6 of FIG. 5.
Figure 7:
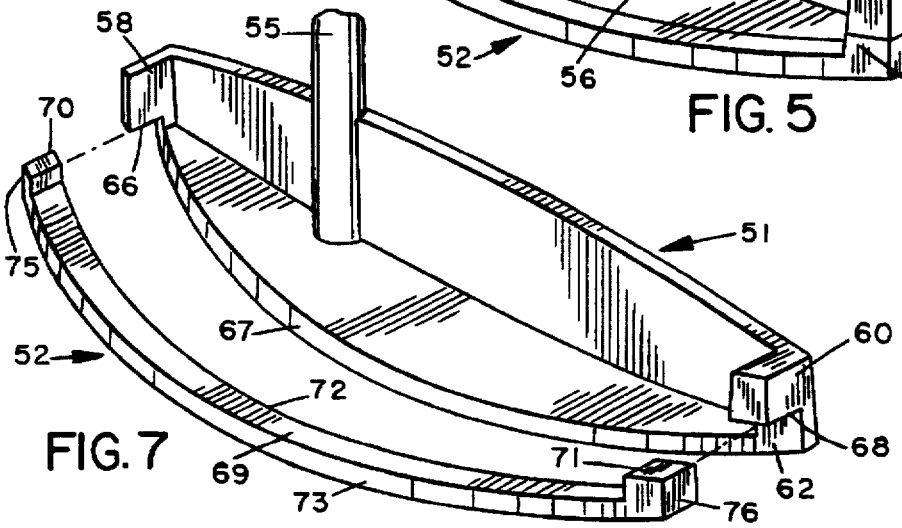
FIG. 7 is a view similar to FIG. 5, with the weight detached.

Although the external weighting system of this invention is shown applied to a mallet-style putter head in FIGS. 1–4, it may alternatively be used in other styles of putter. FIGS. 5–7 of the drawings illustrate an alternative, blade-type putter head 50 according to a second embodiment of the invention. As in the previous embodiment, the head 50 comprises a main body portion 51 and a weighting member 52 of heavier material secured to the main body.

Putter head 50 is of generally L-shaped cross-section, as best illustrated in FIG. 6, and has a relatively thin front wall 53 forming the front, striking face 54 of the putter, a perpendicular lower wall or sole plate 56 extending rearwardly from the lower edge of front wall 53, and end walls 58,60 extending rearwardly from the heel and toe ends, respectively, of the front wall. A hosel tube 55 is suitably secured in a rearwardly facing groove or recess in the front wall 52, as illustrated in FIGS. 5 and 7, and the lower end of a golf club shaft may be suitably secured in tube 55. Alternatively, the lower end of the shaft may be directly secured to the front wall in a similar manner.

An arcuate recess 62 is formed across the rear of the sole plate 56 and end walls 58 and 60 for receiving the arcuate weighting member 52 which forms a mating, smooth continuation of the sole plate and end walls. Recess 62 extends across the sole plate and includes upwardly indented portions 65,66 in each of the end walls 58 and 60, respectively. Arcuate inner face 67 of the recess 62 extends across the sole plate 56 and indented portions of the two end walls. Weighting member 52 is of generally arcuate shape and has a flat central portion 69 of a thickness matching that of the sole plate 56, and raised, thicker end portions 70,71 for fitting into the indented portions 66,68 respectively, of the end walls. Member 64 has curved inner and outer faces 72,73 of matching curvature. Inner face 72 is shaped for mating engagement with the arcuate inner face 67 of recess 62, as illustrated in FIG. 5, while outer face 73 forms an outer perimeter or rear end edge of the club head. The lower face 74 of weighting member 64 forms a flush continuation of the sole of the club head, as illustrated in FIG. 6. Weighting member 64 has flat end faces 75 and 76 which will be flush with the corresponding end faces of end walls 58 and 60, respectively, when the member 64 is appropriately secured in the recess.

As in the previous embodiment, the main body of the club head 50 is of a low density material such as aluminum, and the weighting member 52 is of high density material such as brass. This will lower the center of gravity of the putter head, and will also provide solid feel and stability to the club, improving accuracy. The weighting member may be secured in recess 62 in any suitable manner, for example by bonding or welding, or may be cast to the main body as in the previous embodiment. As in the previous embodiment, the weighting member is spaced a short distance behind the striking face at the heel and toe ends of the club, and will have substantially the same effect in providing perimeter weighting, stability and solid feel to the club head.

FIGS. 8–10 illustrate steps in a method of making the golf putter of FIGS. 1–4. It will be understood that an equivalent method may be used to make the putter of FIGS. 5–7.

The weighting member 16 is first formed in the selected, high density material. The material selected must be high density and also have a relatively high melting point. Suitable materials are stainless steel, brass, or tungsten, for example. The member 16 may be formed in any suitable manner, such as investment casting, machining, forging, and sand casting. The member is formed in the shape illustrated in FIGS. 2–4, and has keying formations 80,81,82 on parts of its surface which will be inside the club head when made. As illustrated in FIG. 8, member 16 may have a first keying formation or projection 80 on flat inner or upper surface 35, and a keying formation or projection 81,82 projecting from each of the inner end faces 36,37, respectively, of the horseshoe shaped member. Each of the projections 80,81,82 will have at least one undercut side edge 83,84,85, respectively, for locking purposes. Although the keying formations 80,81 and 82 are projections in the illustrated embodiment, it will be understood that recesses or depressions of equivalent shapes may be used. Additionally, a greater or lesser number of keying formations may be used, and the formations may be of different shapes from those shown, although they should have undercut edges in all cases.

The formed weighting member 16 is then placed into a cavity 86 of a split mold or die 87 at a position corresponding to the desired location of the weighting member in the formed club head, as illustrated in FIG. 9. The cavity 86 is shaped to correspond to the desired shape of the formed putter head, and the outer surfaces of the member 16 will fit flush against the surface of the cavity 86 along parts of the surface which will correspond to the sole face, rear face, heel and toe faces in the finally formed club head. The weighting member 16 is suitably fixed in place in the lower half of the die-casting cavity 86, and the upper half of the die is placed over the lower half and secured. Molten low density material, such as aluminum, is then injected into the cavity around the weighting member. The molten material is allowed to harden, and will capture the weighting member and will also form the rest of the finished putter body. The remainder of the putter body will be interlocked with the weighting member via the keying formations which will lock into the hardened material as illustrated in FIG. 10. The material used for the remainder of the putter body may be any suitable low density material which has a soft feel on impact with a ball, such as aluminum, plastic, or like materials.

This is an easy and inexpensive method of making the club head, and the club head will be less expensive to manufacture than other weighted putters involving embedded weights or weights in regions offset from the outer perimeter.

Although some preferred embodiments of the invention have been described above by way of example only, it will be understood by those skilled in the field that modifications may be made to the disclosed embodiments without departing from the scope of the invention, which is defined by the appended claims.

We claim:

1. A golf putter, comprising:

an elongate shaft having an upper end and a lower end;

a club head secured to the lower end of the shaft, the head having a main body portion comprising a front, striking face, a sole face extending rearwardly from the striking face, and an outer perimeter defining heel, toe and rear faces of the club head;

the sole face of the main body portion having an arcuate indent extending outwardly to the outer perimeter of the heel, toe and rear faces;

an arcuate weighting member secured in said indent, the weighting member being of shape and dimensions matching the shape and dimensions of said indent and having a lower face extending flush with said lower sole face and an outer peripheral edge extending flush with the outer perimeter of said heel, toe and rear faces; and the main body portion being of a first material having a first density, and the weighting member being of a second material of higher density than said first material.

2. The putter as claimed in claim 1, wherein the club head is mallet-shaped and the main body portion has a solid body extending rearwardly from said striking face including an upper face extending rearwardly to said rear face.

3. The putter as claimed in claim 2, wherein the weighting member has a flat upper face and flat end faces and the indent has a corresponding flat lower face and flat end faces, the flat end faces of the recess being substantially parallel with the striking face and spaced a predetermined distance behind the striking face.

4. The putter as claimed in claim 1, wherein the recess and the weighting member are of corresponding, horseshoe shape.

5. The putter as claimed in claim 1, wherein the main body portion comprises a front wall forming said striking face, the front wall having a lower edge, an upper edge, and opposite heel and toe ends, and a lower wall extending rearwardly from the lower edge of the front wall, the lower wall having an arcuate rear edge defining said indent, and the weighting member comprises an arcuate member secured to the rear edge of said lower wall and having a rear perimeter forming part of outer perimeter of the club head.

6. The putter as claimed in claim 5, wherein the weighting member is flat and has a thickness equal to the thickness of said lower wall.

7. The putter as claimed in claim 5, wherein the main body includes heel and toe flanges extending rearwardly from the heel and toe ends of the front wall, the heel and toe flanges having cut out recesses forming part of said indent, and the weighting member has a flat central portion for fitting against the rear edge of the lower wall and raised opposite end portions for fitting into the respective recesses in said heel and toe flanges.

8. The putter as claimed in claim 1, wherein the main body is of aluminum and the weighting member is of brass.

9. A golf club putter head, comprising:

a main body portion of a first material having a front, striking face, a sole face, heel and toe faces and a rear face, the main body portion having an arcuate indent in the sole face extending outwardly to the heel, toe and rear face of the main body portion;

an arcuate weighting member secured in said arcuate indent and being shaped and dimensioned for close, mating engagement in said indent;

the weighting member having a lower face flush with the sole face of said main body portion and forming a smooth continuation of said sole face, and an outer peripheral edge forming at least part of the outer perimeter of said putter head and having faces extending flush with the rear, heel and toe faces of the main body portion; and the weighting member being of a second material of higher density than said first material.

10. The head as claimed in claim 9, wherein the main body portion comprises a generally mallet-shaped, solid body including an upper face extending rearwardly to the rear face, and the indent and weighting member are of corresponding, horseshoe shape.

11. The head as claimed in claim 10, wherein the indent has a curved inner face following the same general contour as the outer perimeter of the putter head and a flat upper face extending from said inner face out to the outer perimeter of the putter head, and the weighting member has a corresponding curved inner face for mating with the inner face of said indent and a flat upper face for mating with the flat upper face of said indent.

12. The head as claimed in claim 9, wherein the main body portion comprises a front wall forming said front striking face, the front wall having a lower edge, and a sole plate extending rearwardly from the lower edge of said front wall, the indent comprising an arcuate cut-out in said sole plate, and the weighting member comprises an arcuate plate for mating engagement in said cut-out to form a rearward continuation of said sole plate.

* * * * *